US010308465B2

(12) United States Patent
Shimodaira

(10) Patent No.: US 10,308,465 B2
(45) Date of Patent: Jun. 4, 2019

(54) SHEET TRANSPORT DEVICE AND IMAGE FORMING APPARATUS

(71) Applicant: FUJI XEROX CO., LTD., Tokyo (JP)

(72) Inventor: Akira Shimodaira, Kanagawa (JP)

(73) Assignee: FUJI XEROX CO., LTD., Tokyo (JP)

( * ) Notice: Subject to any disclaimer, the term of this patent is extended or adjusted under 35 U.S.C. 154(b) by 0 days.

(21) Appl. No.: 15/800,084

(22) Filed: Nov. 1, 2017

(65) Prior Publication Data

US 2018/0237238 A1 Aug. 23, 2018

(30) Foreign Application Priority Data

Feb. 17, 2017 (JP) ..... 2017-028311

(51) Int. Cl.

| | |
|---|---|
| ***B65H 27/00*** | (2006.01) |
| ***B65H 3/06*** | (2006.01) |
| ***B65H 5/06*** | (2006.01) |
| ***G03G 15/00*** | (2006.01) |

(52) U.S. Cl.

CPC ..... *B65H 27/00* (2013.01); *B65H 3/0638* (2013.01); *B65H 5/062* (2013.01); *G03G 15/6529* (2013.01); *G03G 15/6558* (2013.01); *B65H 2404/11* (2013.01); *B65H 2404/133* (2013.01); *B65H 2404/5321* (2013.01); *B65H 2404/5322* (2013.01); *B65H 2511/14* (2013.01); *G03G 15/657* (2013.01); *G03G 2215/00679* (2013.01)

(58) Field of Classification Search

CPC .. B65H 5/062; B65H 3/0638; B65H 2511/14; B65H 2404/5321; B65H 27/00; B65H 9/004; B65H 9/006; B65H 9/008

See application file for complete search history.

(56) References Cited

U.S. PATENT DOCUMENTS

| | | | | |
|---|---|---|---|---|
| 8,342,519 | B2 * | 1/2013 | Watanabe | B65H 9/004 271/243 |
| 8,419,604 | B2 * | 4/2013 | Haller | B65H 5/00 493/405 |
| 9,193,551 | B2 * | 11/2015 | Kamijo | B65H 9/06 |
| 9,244,419 | B2 * | 1/2016 | Hatazaki | B65H 5/062 |
| 2003/0193127 | A1 * | 10/2003 | Ishibashi | B65H 27/00 271/109 |
| 2005/0001374 | A1 * | 1/2005 | Mukai | B65H 5/062 271/272 |

(Continued)

FOREIGN PATENT DOCUMENTS

| | | | | |
|---|---|---|---|---|
| JP | H062537 | B2 * | 1/1994 | B32B 38/1866 |
| JP | 10-109778 | | 4/1998 | |

*Primary Examiner* — Patrick Cicchino

(74) *Attorney, Agent, or Firm* — JCIPRNET

(57) ABSTRACT

A sheet transport device includes pre-transfer sheet-transport rollers that transport a sheet to a transfer position at which an unfixed image is transferred, the pre-transfer sheet-transport rollers including a first roller in which three or more separate rollers attached to a first shaft rotate, and a second roller in which three or more separate rollers attached to a second shaft are in contact with the separate rollers of the first roller and rotate. The hardness of an inner separate roller of the first roller is lower than the hardness of end separate rollers of the first roller. The outside diameter of an inner separate roller of the second roller is greater than the outside diameter of end separate rollers of the second roller.

5 Claims, 8 Drawing Sheets

(56) References Cited

U.S. PATENT DOCUMENTS

| | | | | |
|---|---|---|---|---|
| 2010/0301546 | A1* | 12/2010 | Ninomiya | B65H 5/062 271/253 |
| 2016/0229650 | A1* | 8/2016 | Iwamoto | B65H 1/04 |
| 2017/0102661 | A1* | 4/2017 | Kameda | B65H 5/062 |
| 2018/0046124 | A1* | 2/2018 | Moriya | G03G 15/5054 |

* cited by examiner

SHEET TRANSPORT DEVICE AND IMAGE FORMING APPARATUS

CROSS-REFERENCE TO RELATED APPLICATIONS

This application is based on and claims priority under 35 USC 119 from Japanese Patent Application No. 2017-028311 filed Feb. 17, 2017.

BACKGROUND

The present invention relates to sheet transport devices and image forming apparatuses.

SUMMARY

A sheet transport device according to an exemplary embodiment of the present invention includes pre-transfer sheet-transport rollers that transport a sheet to a transfer position at which an unfixed image is transferred, the pre-transfer sheet-transport rollers including a first roller in which three or more separate rollers attached to a first shaft rotate, and a second roller in which three or more separate rollers attached to a second shaft are in contact with the separate rollers of the first roller and rotate. The hardness of an inner separate roller of the first roller is lower than the hardness of end separate rollers of the first roller. The outside diameter of an inner separate roller of the second roller is greater than the outside diameter of end separate rollers of the second roller.

BRIEF DESCRIPTION OF THE DRAWINGS

Exemplary embodiments of the present invention will be described in detail based on the following figures, wherein:

FIG. 1 shows the configuration of an image forming apparatus including a sheet transport device according to a first exemplary embodiment or the like;

DETAILED DESCRIPTION

Exemplary embodiments of the present invention will be described below with reference to the drawings.

First Exemplary Embodiment

Figure 1:
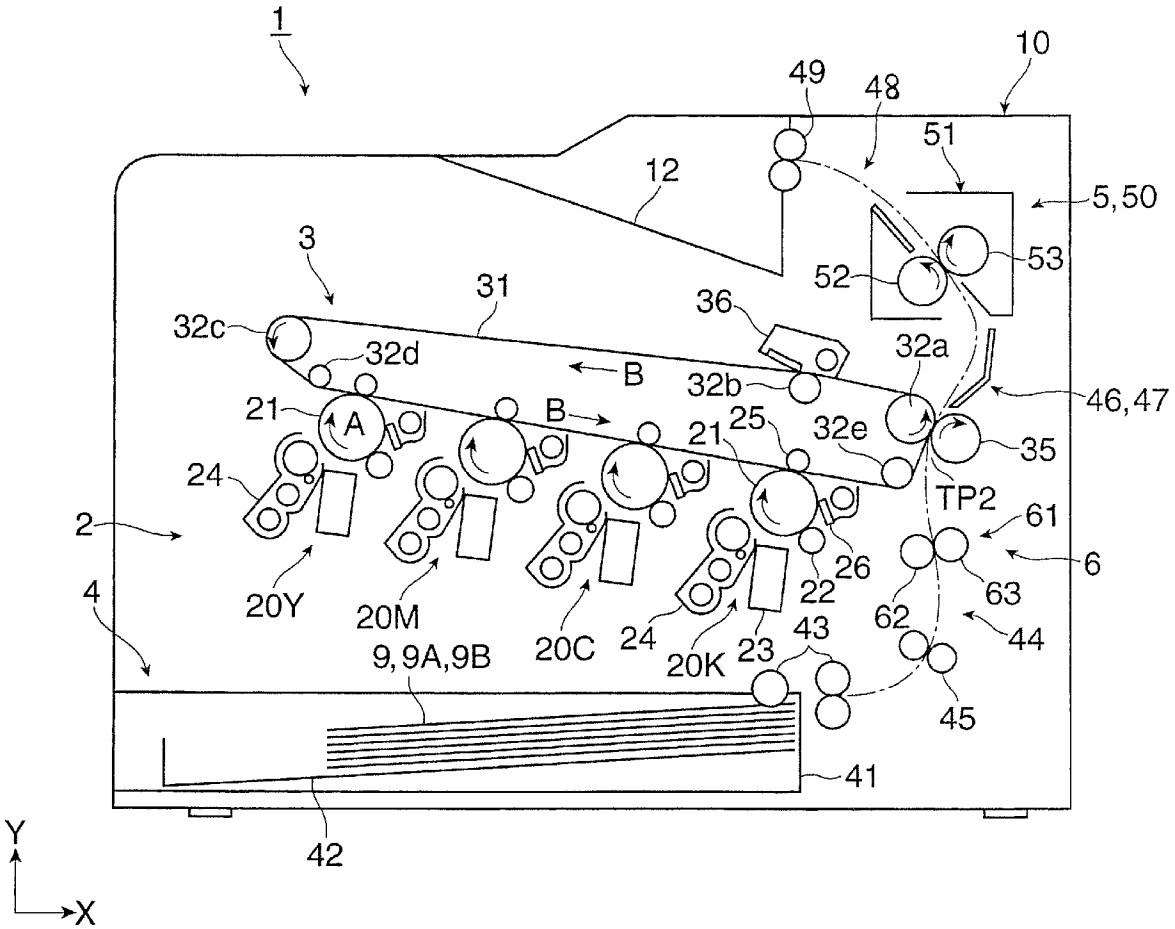
Figure 2:
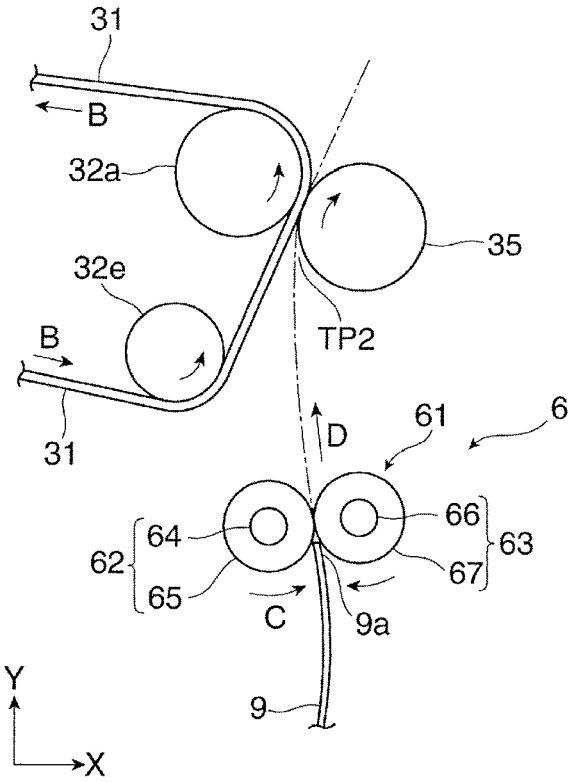
FIG. 2 shows, in an enlarged manner, the relevant part (the sheet transport device and portions constituting a second-transfer position) of the image forming apparatus in FIG. 1.
Figure 3:
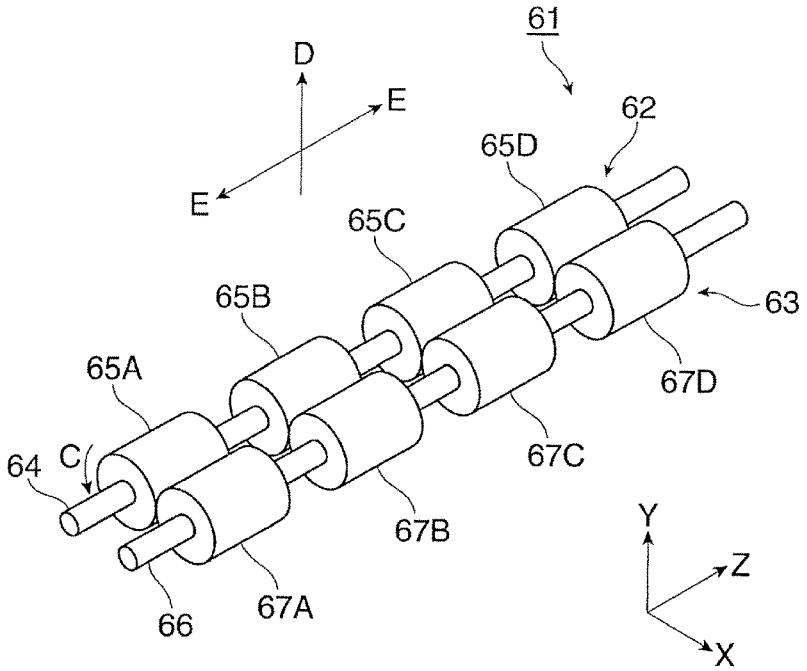
FIG. 3 is a schematic perspective view of pre-transfer sheet-transport rollers in the sheet transport device in FIG. 1.

FIGS. 1 and 2 show an image forming apparatus including a sheet transport device according to a first exemplary embodiment. FIG. 1 shows the configuration of the image forming apparatus, and FIG. 2 shows the relevant part (i.e., the sheet transport device and structural parts therearound) of the image forming apparatus. The arrows with reference signs X, Y, and Z in FIGS. 1 and 2 represent the directions of the Cartesian-coordinate axes indicating width, height, and depth in three-dimensional spaces assumed in the drawings.

Configuration of Image Forming Apparatus

An image forming apparatus 1 according to the first exemplary embodiment includes, in the inner space of a housing 10: multiple image forming parts 2 that form unfixed images (toner images), which are formed of developer, according to image information; an intermediate transfer part 3 that transports the toner images formed by the image forming parts 2; a paper feed part 4 that stores and feeds sheets 9 to which the toner images on the intermediate transfer part 3 are second-transferred; a fixing part 5 that fixes the toner images to the sheet 9, to which the unfixed toner images are second-transferred at the second-transfer position of the intermediate transfer part 3; and the like. This image forming apparatus 1 also includes a sheet transport device 6 that transports the sheet 9 to the second-transfer position of the intermediate transfer part 3.

Examples of the image information include text, figures, pictures, and colors. The housing 10 has, in the top surface thereof, an output-sheet storing part 12 that stores, in a stacked manner, the sheets 9 discharged after images are formed thereon. The one-dot chain line in FIG. 1 indicates a transport path along which the sheets 9 are transported in the inner space of the housing 10.

The multiple image forming parts 2 include four image forming devices 20Y, 20M, 20C, and 20K that form yellow (Y), magenta (M), cyan (C), and black (K) toner images, respectively.

As shown in FIG. 1, these four image forming devices 20 (Y, M, C, and K) each include: a photoconductive drum 21 that is rotationally driven in the direction indicated by an arrow A; a charging device 22 that charges an image carrying surface of the photoconductive drum 21; an exposure device 23 that forms, by radiating light, an electrostatic latent image on the charged image carrying surface of the photoconductive drum 21; a developing device 24 that develops the electrostatic latent image with developer to form a toner image; a first-transfer device 25 that first-transfers the toner image to the intermediate transfer part 3; and a drum cleaning device 26 that cleans the photoconductive drum 21 by removing undesired substances deposited on the image carrying surface thereof. In FIG. 1, all the components of the image forming device 20K are denoted by reference signs (21 to 26), and some, but not all, of the components of the other image forming devices, 20Y, 20M, and 20C, are denoted by reference signs.

The intermediate transfer part 3 is located above the image forming devices 20 (Y, M, C, and K), serving as the image forming parts 2.

The intermediate transfer part 3 includes: the intermediate transfer belt 31 that revolves in the direction indicated by an arrow B so as to pass, in a contact manner, through first-transfer positions facing the first-transfer devices 25 of the photoconductive drums 21 of the image forming devices 20 (Y, M, C, and K); multiple support rollers 32*a* to 32*e* that are in contact with the intermediate transfer belt 31 from the inner circumferential surface so as to support the intermediate transfer belt 31 in a desired state, in a rotatable manner; a second transfer device 35 that presses a sheet 9 against the intermediate transfer belt 31 supported by the support roller 32*a* so that the toner images on the intermediate transfer belt 31 are second-transferred to the sheet 9, and a belt cleaning device 36 that cleans the intermediate transfer belt 31 by removing undesired substances deposited thereon.

The intermediate transfer belt 31 serves as an image carrier that carries unfixed toner images to be transferred to the sheet 9.

The support roller 32*a* serves as a driving roller that makes the intermediate transfer belt 31 revolve, as well as a backup roller used in the second transfer, the support roller 32*b* serves as a backup roller for the belt cleaning device 36, the support roller 32*c* serves as a tension-applying roller that applies a certain tension to the intermediate transfer belt 31, and the support rollers 32*d* and 32*e* serve as surface-forming rollers that support the intermediate transfer belt 31 so as to form a first transfer surface.

The paper feed part 4 is located below the image forming devices 20 (Y, M, C, and K), serving as the image forming parts 2.

This paper feed part 4 includes a container 41 that stores, on the top surface of a loading plate 42, a stack of sheets 9 of desired size and type, and a feeder 43 that feeds the sheets 9 from the container 41 on a one-by-one basis. The container 41 can be drawn toward the front side of the housing 10 (i.e., the side a user faces when operating the apparatus). More than one pair of the container 41 and the feeder 43 may be provided, if necessary.

The sheets 9 are recording media that can be transported along the transport path in the housing 10, and to which toner images can be transferred and fixed. The sheets 9 are preliminarily cut in predetermined sizes. The sheets 9 other than those having a sheet shape, such as those of an envelope type, may also be used.

The fixing part 5 is located above the second-transfer position (i.e., the position between the intermediate transfer belt 31 and the second transfer device 35) TP2 of the intermediate transfer part 3.

The fixing part 5 includes a fixing device 50. The fixing device 50 includes, inside a housing 51 having an introduction port and a discharge port for sheets 9, a heating rotary body 52 of a roller, belt, or other type, which rotates in the direction indicated by the arrow and is heated by a heating unit (not shown) such that the surface temperature thereof is maintained at a predetermined temperature, and a pressure-applying rotary body 53 of a roller, belt, or other type, which is in contact with the heating rotary body 52 at a predetermined pressure so as to be substantially parallel to the axial direction of the heating rotary body 52 and is rotated in a driven manner. In the fixing device 50, a portion at which the heating rotary body 52 and the pressure-applying rotary body 53 are in contact with each other constitutes a fixing processing part at which heat and pressure are applied.

The image forming apparatus 1 includes, in the inner space of the housing 10, at a position between the paper feed part 4 and the intermediate transfer part 3, a feed-and-transport path 44 that transports and feeds a sheet 9 fed from the paper feed part 4 to the second-transfer position TP2 of the intermediate transfer part 3.

The feed-and-transport path 44 includes multiple sheet-transport rollers 45 and 61, multiple sheet guide members (not shown), and the like. The sheet-transport rollers 61 are transport rollers through which a sheet passes immediately before transferring (hereinbelow, pre-transfer sheet-transport rollers 61). The pre-transfer sheet-transport rollers 61 transport the sheet 9 toward the second-transfer position TP2 of the intermediate transfer part 3. The pre-transfer sheet-transport rollers 61 serve as registration rollers having a function of adjusting the timing of transporting (feeding) the sheet 9 to the second-transfer position TP2 and a function of adjusting the transport orientation (i.e., correcting oblique feeding). The sheet-transport rollers 61 in the feed-and-transport path 44 constitute a part of the sheet transport device 6 described below.

Furthermore, a relay transport path 46 along which a sheet 9 after second transfer is transported to the fixing part 5 is provided in the inner space of the housing 10, between the second-transfer position TP2 of the intermediate transfer part 3 and the fixing part 5. The relay transport path 46 includes a sheet guide member 47.

Furthermore, a discharge transport path 48 along which a sheet 9 having an image formed and fixed thereon is transported so as to be discharged on the output-sheet storing part 12 is provided in the inner space of the housing 10, between the fixing part 5 and a sheet discharge port in the housing 10. The discharge transport path 48 includes discharging rollers 49 and a sheet guide member (not shown).

Image Forming Operation of Image Forming Apparatus

A basic image forming operation performed by the image forming apparatus 1 will be described. An operation in an example case where a full-color image formed of toner images of four colors (Y, M, C, and K) is formed will be described.

First, when an image-forming-operation start instruction is issued, as shown in FIG. 1, the photoconductive drums 21 of the four image forming devices 20 (Y, M, C, and K), serving as the image forming parts 2, are rotated in the direction indicated by the arrows, and the charging devices 22 charge the image carrying surfaces of the photoconductive drums 21 to a certain (for example, negative) polarity and electric potential. Then, the exposure devices 23 perform exposure according to image signals decomposed into respective color components (Y, M, C, and K) on the respective charged photoconductive drums 21 to form electrostatic latent images of the respective color components, having certain electric potentials, on the image carrying surfaces of the photoconductive drums 21.

Then, the developing devices 24 (Y, M, C, and K) of the image forming devices 20 (Y, M, C, and K) develop images by supplying color (Y, M, C, and K) toners charged to a certain (negative) polarity to the electrostatic latent images of the respective color components (Y, M, C, and K) formed on the photoconductive drums 21, allowing the toners to electrostatically attach. As a result, the toner images of the four colors (Y, M, C, and K) are formed on the image carrying surfaces of the photoconductive drums 21 of the image forming devices 20 (Y, M, C, and K), respectively.

Then, the toner images of four colors formed on the respective photoconductive drums 21 of the image forming devices 20 (Y, M, C, and K) are sequentially (in order of Y, M, C, and K) first-transferred to the outer circumferential surface of the intermediate transfer belt 31 of the intermediate transfer part 3 by receiving transfer effects of the first-transfer devices 25. The photoconductive drums 21 are cleaned by the drum cleaning devices 26.

Then, the unfixed toner images first-transferred to the outer circumferential surface of the intermediate transfer belt 31 at the intermediate transfer part 3 and held thereon are transported to the second-transfer position TP2 by the intermediate transfer belt 31, which revolves in the direction indicated by an arrow B. Meanwhile, in the paper feed part 4, a sheet 9 is transported such that it is fed out of the container 41 by the feeder 43 and is fed to the second-transfer position TP2 via the feed-and-transport path 44. Then, at the second-transfer position TP2 of the intermediate transfer part 3, the toner images on the intermediate transfer belt 31 are simultaneously second-transferred to one side of the sheet 9 by receiving the transfer effect from the second transfer device 35.

Next, the sheet 9 to which the unfixed toner image is second-transferred is transported such that it is separated from the intermediate transfer belt 31 and is fed to the fixing part 5 via the relay transport path 46. In the fixing device 50 of the fixing part 5, the sheet 9 is introduced to the fixing processing part, at which the heating rotary body 52 and the pressure-applying rotary body 53 are in contact, and is subjected to heat and pressure as it passes therethrough. This way, the toner images are fused and fixed to the sheet 9.

Then, the sheet 9 to which the toner images have been fixed in the fixing part 5 is discharged from the fixing device 50 of the fixing part 5, is transported via the discharge transport path 48, is discharged to the outside of the housing 10 by the discharging rollers 49, and is then stored in the output-sheet storing part 12.

Through the above-described operation, the sheet 9 having a full-color image formed on one side is output.

Configuration of Sheet Transport Device

Next, the sheet transport device 6 will be described.

As shown in FIGS. 1 to 4, etc., the sheet transport device 6 includes, at least, the pre-transfer sheet-transport rollers 61 that transport a sheet 9 to the second-transfer position TP2 and that include a first roller 62 and a second roller 63.

The first roller 62 includes a first shaft 64, and four separate rollers 65A, 65B, 65C, and 65D that are fixed to and rotate with the first shaft 64. The first shaft 64 is rotatably attached at the ends to a support frame 70 via bearings 71.

The first roller 62 also serves as a driving roller that drivingly rotates in a rotation direction C by receiving a rotational force from a rotational driving device 74, which includes a stepping motor, a rotation transmitting mechanism, etc.

The second roller 63 includes a second shaft 66, and four separate rollers 67A, 67B, 67C, and 67D that are fixed to and rotate with the second shaft 66. The second shaft 66 is rotatably attached at the ends to the support frame 70 via bearings 72 that are movable, in elongated holes (not shown), toward and away from the first roller 62.

The second roller 63 serves as a driven roller in which the separate rollers 67A, 67B, 67C, and 67D are in contact with the separate rollers 65A, 65B, 65C, and 65D of the first roller 62, respectively, and are rotated in a driven manner.

The ends of the second shaft 66 of the second roller 63 (or the bearings 72) are pressed toward the first shaft 64 of the first roller 62 at a certain pressure P by pressure-applying parts 75, such as pressure-applying springs. Thus, the separate rollers 67A, 67B, 67C, and 67D are pressed against the separate rollers 65A, 65B, 65C, and 65D of the first roller 62 at a certain pressing force.

In the pre-transfer sheet-transport rollers 61 of the sheet transport device 6, the hardness J1 of the inner separate rollers 65B and 65C of the first roller 62 is lower than the hardness J2 of the end separate rollers 65A and 65D thereof (J1<J2), and the outside diameter K1 of the inner separate rollers 67B and 67C of the second roller 63 is greater than the outside diameter K2 of the end separate rollers 67A and 67D thereof (K1>K2).

The hardness J1 of the inner separate rollers 65B and 65C of the first roller 62 and the hardness J2 of the end separate rollers 65A and 65D thereof are the hardness of elastic members measured with an Asker C hardness tester, when all the separate rollers 65B, 65C, 65A, and 65D are formed of an elastic member, such as rubber.

The hardness J1 is, for example, about 0.5 to 0.9 times the hardness J2. How much the hardness J1 is lower than the hardness J2 may be set by taking into consideration, for example, the difference between the outside diameter K1 of the inner separate rollers 67B and 67C and the outside diameter K2 of the end separate rollers 67A and 67D of the second roller 63.

The separate rollers 65A, 65B, 65C, and 65D according to the first exemplary embodiment are formed of a rubber material, such as an ethylene rubber or a nitrile rubber, and the hardness J1 and the hardness J2 of the separate rollers are set by adjusting the composition or the like of rubber material. The separate rollers 67A, 67B, 67C, and 67D of the second roller 63 have the same hardness (J3), which is higher than the hardness J1 and the hardness J2 of the separate rollers 65 of the first roller 62.

The outside diameter K1 of the inner separate rollers 67B and 67C of the second roller 63 is, for example, about 1.1 to 1.2 times the outside diameter K2 of the end separate rollers 67A and 67D thereof. How much the outside diameter K1 is greater than the outside diameter K2 may be set by taking into consideration, for example, the difference between the hardness J1 of the inner separate rollers 65B and 65C and the hardness J2 of the end separate rollers 65A and 65D of the first roller 62.

The separate rollers 67A, 67B, 67C, and 67D in the first exemplary embodiment are formed of, for example, a synthetic resin material, such as acrylonitrile-butadiene-styrene (ABS) copolymer resin or polyacetal (POM) resin. The separate rollers 65A, 65B, 65C, and 65D of the first roller 62 have the same outside diameter K3, which equals the outside diameter K2 of the end separate rollers 67A and 67D of the second roller 63.

Furthermore, in the sheet transport device 6, the first roller 62 of the pre-transfer sheet-transport rollers 61 is disposed on the side to be in contact with the surface of a sheet 9 to which an unfixed image is transferred.

In the image forming apparatus 1, as shown in FIG. 2, etc., this configuration is achieved by disposing the first roller 62 closer to the intermediate transfer belt 31 of the intermediate transfer part 3, which carries an unfixed toner image, than the second roller 63 is.

Furthermore, while the pre-transfer sheet-transport rollers 61 of the sheet transport device 6 are not transporting a sheet 9, the ends of the second shaft 66 of the second roller 63 (or the bearings 72) are pressed by the pressure-applying parts 75 at substantially the same pressure P. Thus, the first shaft 64 of the first roller 62 and the second shaft 66 of the second roller 63 are maintained substantially parallel, at a certain distance L from each other.

Figure 4A:
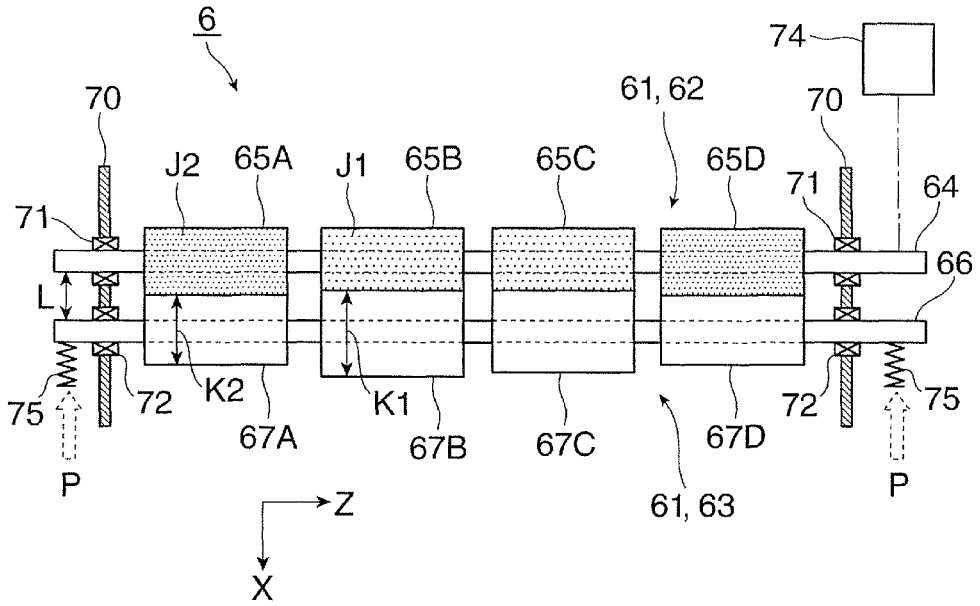
FIG. 4A shows the configuration of the sheet transport device.
Figure 4B:
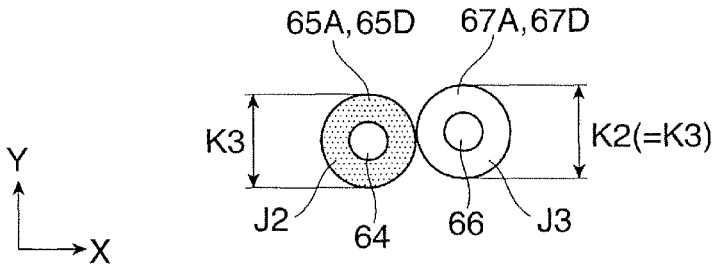
FIG. 4B shows a pressure-contact state between end separate rollers of the pre-transfer sheet-transport rollers.

As a result, as shown in FIG. 4B, the end separate rollers 67A and 67D of the second roller 63 are pressed against the end separate rollers 65A and 65D of the first roller 62 to an extent that the end separate rollers 65A and 65D are slightly depressed.

Figure 4C:
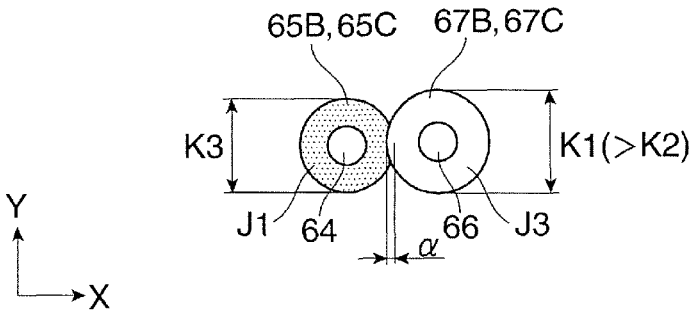
FIG. 4C shows a pressure-contact state between inner separate rollers of the pre-transfer sheet-transport rollers.

Meanwhile, as shown in FIG. 4C, the inner separate rollers 67B and 67C of the second roller 63 are pressed against the end separate rollers 65A and 65D of the first roller 62 to an extent that the end separate rollers 65A and 65D are depressed by a predetermined depression amount a, because the outside diameter K1 of the inner separate rollers 67B and 67C of the second roller 63 is relatively large, and the hardness J1 of the end separate rollers 65A and 65D of the first roller 62 is relatively low.

The first shaft 64 of the first roller 62 is disposed substantially parallel to the axial direction of the second-transfer position TP2 of the intermediate transfer part 3 (more specifically, the axial direction of the support roller 32*a* and the axial direction of the second transfer roller of the second transfer device 35).

Operation of Sheet Transport Device

In the sheet transport device 6, during the above-described image forming operation or the like, the pre-transfer sheet-transport rollers 61 (the first roller 62 and the second roller 63) start rotating at predetermined timing after temporarily stop rotating. The predetermined timing is, for example, timing not late for starting of transferring of toner images at the second-transfer position TP2.

Thus, a leading-end portion 9*a* of the sheet 9 in the transport direction D comes into contact with press-contact portions between the separate rollers 65A to 65D of the first roller 62 and the separate rollers 67A to 67D of the second roller 63, which are not rotating, and the sheet 9 that is transported from the paper feed part 4 toward the second-transfer position TP2 of the intermediate transfer part 3 via the feed-and-transport path 44 is temporarily stopped.

As a result, even if the leading-end portion 9*a* of the sheet 9 in the transport direction D is transported to the pre-transfer sheet-transport rollers 61 so as to be oblique to the transport direction D, the leading-end portion 9*a* of the sheet 9 becomes parallel to the press-contact portion between the first roller 62 and the second roller 63, and is corrected so as to be substantially parallel to the axial direction of the first shaft 64 of the first roller 62.

Subsequently, when the first roller 62 and the second roller 63 in the pre-transfer sheet-transport rollers 61 start rotating at predetermined timing, the leading-end portion 9*a* of the sheet 9 in the transport direction D starts to be transported while being nipped between the first roller 62 and the second roller 63.

This way, the sheet 9 is transported by the pre-transfer sheet-transport rollers 61 toward the second-transfer position TP2 of the intermediate transfer part 3.

Figure 5A:
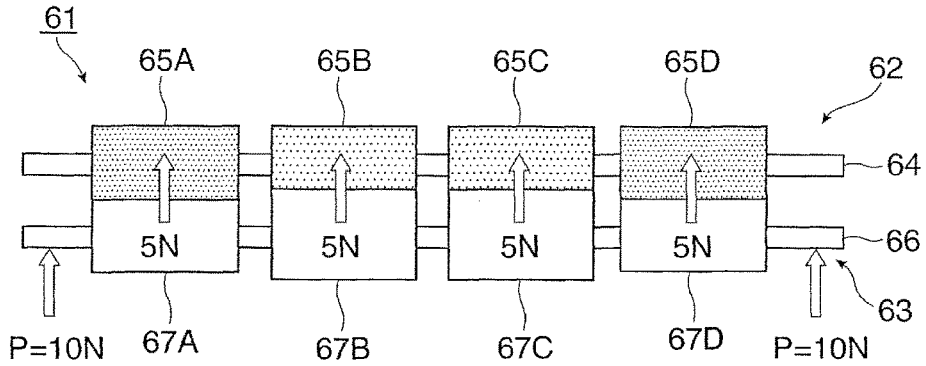
FIG. 5A shows a pressure state in the pre-transfer sheet-transport rollers, and a state of pressure-contact load between each pair of separate rollers while a sheet is not transported.

At this time, in the sheet transport device 6, as shown in FIG. 5A, when the ends of the second shaft 66 of the second roller 63 (or the bearings 72) are pressed with the pressure-applying parts 75 at a pressure P of 10 N (newton), the pressure-contact loads between the end separate rollers 65A and 67A, and 65D and 67D of the first roller 62 and the second roller 63 are both substantially 5 N, and the pressure-contact loads between the inner separate rollers 65B and 67B, and 65C and 67C of the first roller 62 and the second roller 63 are both substantially 5 N.

Note that, the hardness J1 of the inner separate rollers 65B and 65C of the first roller 62 at this time is set to about 50 degrees, and the hardness J2 of the end separate rollers 65A and 65D is set to about 80 degrees. The outside diameter K1 of the inner separate rollers 67B and 67C of the second roller 63 is set to about 15 mm, and the outside diameter K2 of the end separate rollers 67A and 67D is set to about 14 mm.

In particular, in the sheet transport device 6, the outside diameter K1 of the inner separate rollers 67B and 67C of the second roller 63 is greater than the outside diameter K2 of the end separate rollers 67A and 67D. Hence, normally (if the distance L between the first shaft 64 and the second shaft 66 is constant), the pressure-contact load with respect to the inner separate rollers 65B and 65C of the first roller 62 is greater than the pressure-contact load with respect to the end separate rollers 65A and 65D.

However, in the sheet transport device 6, because the hardness J1 of the inner separate rollers 65B and 65C of the first roller 62 is lower than the hardness J2 of the end separate rollers 65A and 65D, the inner separate rollers 65B and 65C elastically deform and absorb the pressure exerted by the inner separate rollers 67B and 67C of the second roller 63, which have a greater outside diameter K1.

Accordingly, in the sheet transport device 6, the pressure-contact loads between the inner separate rollers 65B and 67B, and 65C and 67C are substantially equal to the pressure-contact loads between the end separate rollers 65A and 67A, and 65D and 67D.

Figure 5B:
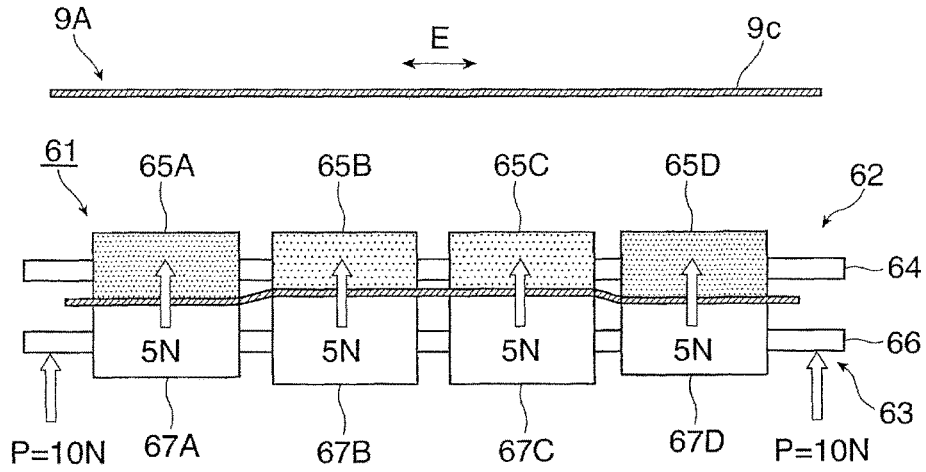
FIG. 5B shows a state of pressure-contact load between each pair of separate rollers when a wide sheet is transported with the sheet-transport rollers in FIG. 5A.

As a result, as shown in, for example, FIG. 5B, when a wide sheet 9A, which has a relatively large length in the width direction E and is transported by being nipped between both the inner separate rollers, 65B, 65C, 67B, and 67C, and the end separate rollers, 65A, 65D, 67A, and 67D, of the first roller 62 and the second roller 63, is transported, the pressure-contact loads are as follows.

Because the wide sheet 9A evenly extends between all pairs of the separate rollers, the pressure-contact loads between the end separate rollers 65A and 67A, and 65D and 67D, and the pressure-contact loads between the inner separate rollers 65B and 67B, and 65C and 67C are all substantially 5 N.

Figure 5C:
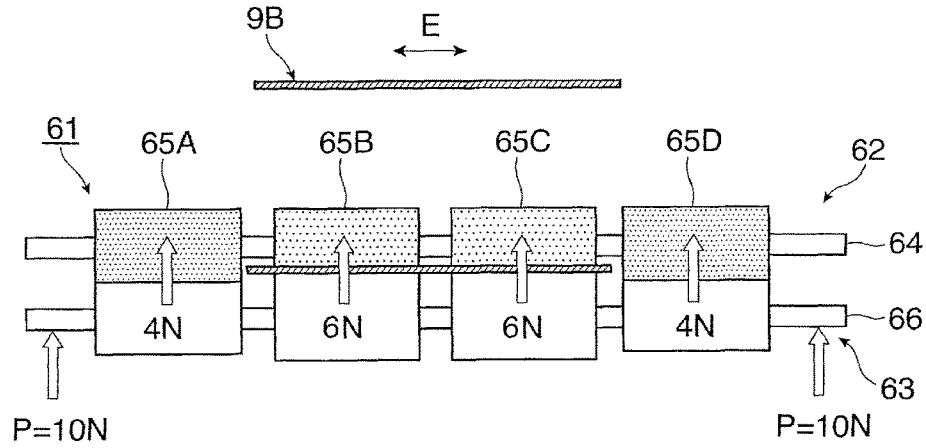
FIG. 5C shows a state of pressure-contact load between each pair of separate rollers when a narrow sheet is transported with the sheet-transport rollers in FIG. 5A.

As shown in, for, example, FIG. 5C, when a narrow sheet 9B, which has a relatively small length in the width direction E and is transported by being nipped between only the inner separate rollers 65B, 65C of the first roller 62 and the inner separate rollers 67B, 67C of the second roller 63, is transported, the pressure-contact loads are as follows.

Because the narrow sheet 9B extends only between the inner separate rollers, the pressure-contact loads between the inner separate rollers 65B and 67B, and 65C and 67C are both about substantially 6 N, which are slightly higher than those in the case of the wide sheet 9A, though they may slightly vary with the thickness of the narrow sheet 9B. At this time, the pressure-contact loads between the end separate rollers 65A and 67A, and 65D and 67D are about 4 N, which are slightly lower than those in the case of the wide sheet 9A, because the narrow sheet 9B does not exist between the end separate rollers 65A and 67A, and 65D and 67D, whereas it exists between the inner separate rollers. The difference between the pressure-contact load (about 4 N) applied to the narrow sheet 9B and the pressure-contact load (5 N) applied to the wide sheet 9A is subtle.

Thus, in the sheet transport device 6, because variations in the pressure-contact load applied from the respective separate roller pairs are small, it is possible to stably feed the sheet 9 (9A, 9B), transported by the pre-transfer sheet-transport rollers 61, to the second-transfer position TP2, serving as the transport destination, regardless of the length of the sheet 9 in the width direction E, which is a direction intersecting the transport direction D.

More specifically, neither the wide sheet 9A nor the narrow sheet 9B is subjected to pressure-contact loads significantly varying among the multiple separate roller pairs of the pre-transfer sheet-transport rollers 61 when transported. Hence, whether the wide sheet 9A or the narrow sheet 9B is transported, there is no risk of the sheet being damaged due to excessively large pressure-contact loads applied from some separate roller pairs during transportation or risk of a transport defect due to lack of transportation force, which is caused by excessively small pressure-contact loads applied by some separate roller pairs.

Figure 6A:
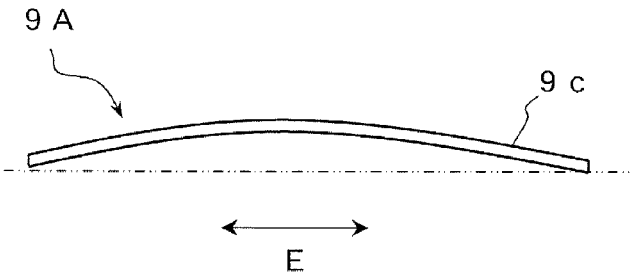
FIGS. 6A and 6B are a front view and a partial perspective view showing a sheet in a curved state when the sheet is fed out from the pre-transfer sheet-transport rollers.
Figure 6B:
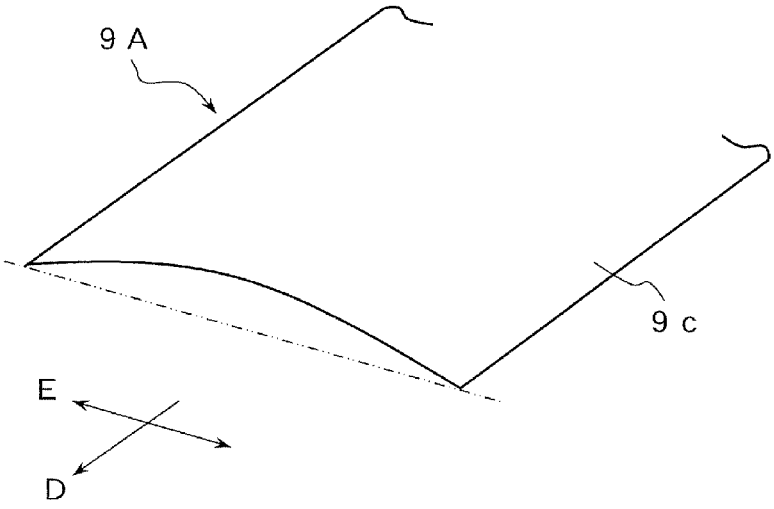

In the sheet transport device 6, as shown in FIGS. 6A and 6B, when a wide sheet 9A is transported, the pre-transfer sheet-transport rollers 61 can feed the wide sheet 9A such that the middle portion thereof in the width direction E projects toward one surface (9*c*). Two-dot chain straight lines in FIGS. 6A and 6B show, for reference, a sheet 9 that is not curved in the width direction E, but is in a flat state.

Specifically, in the pre-transfer sheet-transport rollers 61 of the sheet transport device 6, the inner separate rollers 67B and 67C of the second roller 63, which have a relatively large outside diameter (K1), press the middle portion of the wide sheet 9A in the width direction E toward the inner separate rollers 65B and 65C of the first roller 62 with a large force corresponding to the large outside diameter thereof. At the same time, the inner separate rollers 65B and 65C of the first roller 62, which have a relatively low hardness (J1) and thus are likely to be elastically deformed because of their lower hardness, accept the pressed state. As a result, when the wide sheet 9A is transported by the pre-transfer sheet-transport rollers 61, the middle portion thereof in the width direction E is curved so as to project toward one surface (9*c*) side.

In the image forming apparatus 1 including the sheet transport device 6, the first roller 62 of the pre-transfer sheet-transport rollers 61 is disposed on the side to be in contact with the surface 9*c* of a sheet 9 to which an unfixed toner image is to be transferred (transfer target surface). Hence, the wide sheet 9A is transported from the sheet-transport rollers 61 as follows.

Figure 7A:
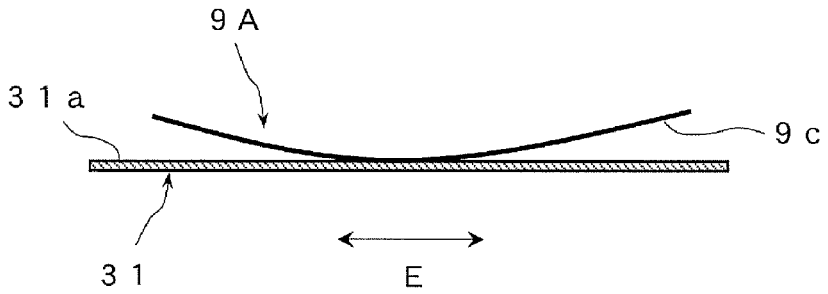
FIGS. 7A to 7C show, in a chronological order, contact states between an intermediate transfer belt and a sheet when the sheet is transported from the sheet transport device.
Figure 7B:
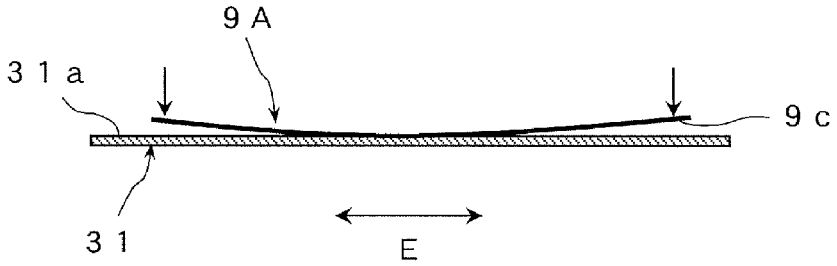
Figure 7C:
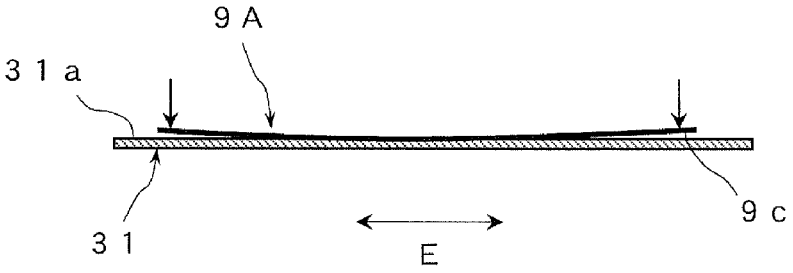

Specifically, as shown in FIGS. 7A to 7C in a chronological order, when the wide sheet 9A is fed, first, the middle portion of the transfer target surface 9*c* in the width direction E comes into contact with a substantially flat outer surface 31*a* of the intermediate transfer belt 31 of the intermediate transfer part 3, then, the ends of the transfer target surface 9*c* in the width direction E gradually approach and come into contact with the substantially flat outer surface 31*a* of the intermediate transfer belt 31, and finally, the entire transfer target surface 9*c* becomes in flat contact with the outer surface 31*a* of the intermediate transfer belt 31, and is fed to a portion serving as the second-transfer position TP2, at which the intermediate transfer belt 31 and (the second transfer roller of) the second transfer device 35 are in contact with each other.

As a result, in the sheet transport device 6, it is possible to prevent the wide sheet 9A transported by the pre-transfer sheet-transport rollers 61 from being creased or causing a transfer defect at the second-transfer position TP2, serving as the transport destination, as a result of, for example, the sheet 9A being fed with wave-like deformation in the width direction E. Hence, the image forming apparatus 1 can properly perform image formation, without causing creases or a transfer defect at the second-transfer position TP2.

Comparison Example

Figure 8A:
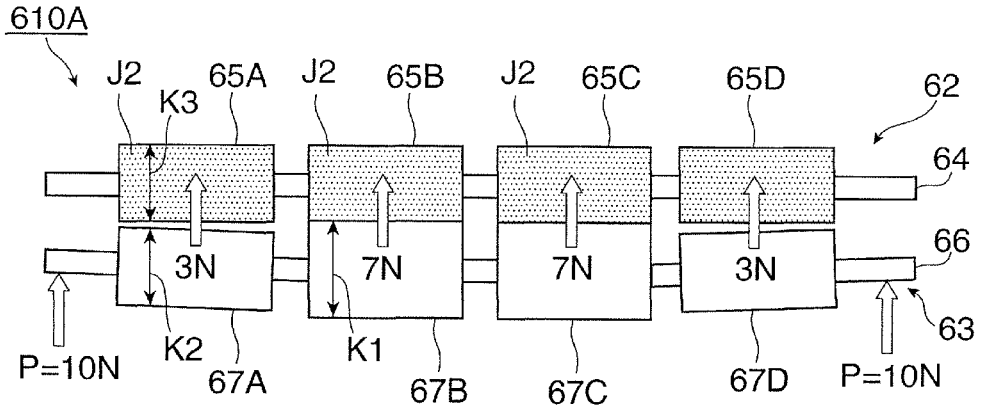
FIG. 8A shows Comparison Example 1 of pre-transfer sheet-transport rollers.

In Comparison Example 1, as shown in FIG. 8A, instead of the pre-transfer sheet-transport rollers 61, for example, pre-transfer sheet-transport rollers 610A in which all four separate rollers 65A, 65B, 65C, and 65D of the first roller 62 have the same hardness, J2, and the outside diameter K1 of the inner separate rollers 67B and 67C of the second roller 63 is greater than the outside diameter K2 of the end separate rollers 67A and 67D (K1>K2) are used.

In the pre-transfer sheet-transport rollers 610A, when a pressure P of 10 N is applied to the ends of the second shaft 66 of the second roller 63 (or the bearings 72) with the pressure-applying parts 75, the pressure-contact loads between the end separate rollers 65A and 67A, and 65D and 67D of the first roller 62 and the second roller 63 are both substantially 3 N, and the pressure-contact loads between the inner separate rollers 65B and 67B, and 65C and 67C are both substantially 7 N.

In Comparison Example 1, the pressure-contact loads between the end separate rollers and the pressure-contact loads between the inner separate rollers of the sheet-transport rollers 610A significantly differ, which may cause failure to stably feed sheets 9 to the second-transfer position TP2, serving as the transport destination.

For example, when a wide sheet 9A is transported, because the middle portion thereof in the width direction E is subjected to a higher pressure-contact load than the ends, the middle portion is damaged, which potentially causes creases or a transfer defect at the second-transfer position TP2, serving as the transport destination. When a narrow sheet 9B is transported, because the sheet is subjected to an excessive pressure-contact loads from the inner separate rollers 65B and 67B, and 65C and 67C, the entire sheet is likely to be damaged, which also potentially causes creases or a transfer defect at the second-transfer position TP2, serving as the transport destination.

Figure 8B:
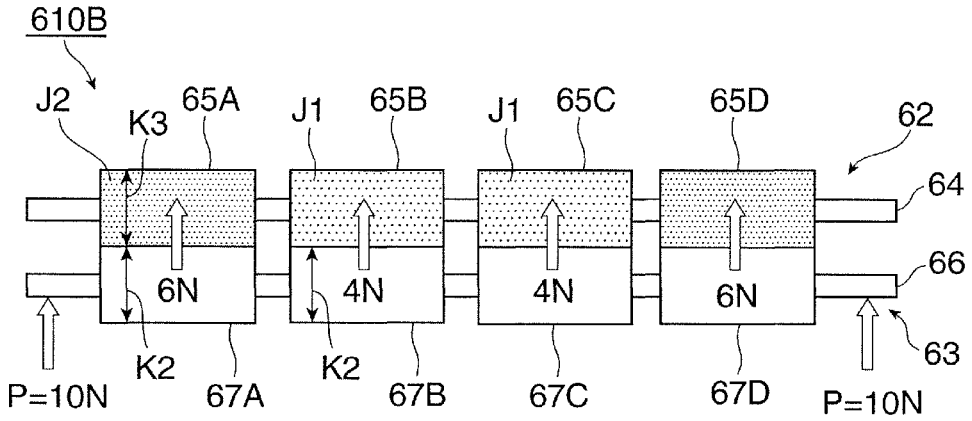
FIG. 8B shows Comparison Example 2 of pre-transfer sheet-transport rollers.

In Comparison Example 2, as shown in FIG. 8B, instead of the pre-transfer sheet-transport rollers 61, for example, pre-transfer sheet-transport rollers 610B in which all four separate rollers 67A, 67B, 67C, and 67D of the second roller 63 have the same outside diameter, K2, and the hardness J1 of the inner separate rollers 65B and 65C of the first roller 62 is lower than the hardness J2 of the end separate rollers 65A and 65D (J1<J2) are used.

In the pre-transfer sheet-transport rollers 610B, when a pressure P of 10 N is applied to the ends of the second shaft 66 of the second roller 63 (or the bearings 72) with the pressure-applying parts 75, the pressure-contact loads between the inner separate rollers 65B and 67B, and 65C and 67C of the first roller 62 and the second roller 63 are both substantially 4 N, and the pressure-contact loads between the end separate rollers 65A and 67A, and 65D and 67D are both substantially 6 N.

In Comparison Example 2, the pressure-contact loads between the inner separate rollers and the pressure-contact loads between the end separate rollers of the sheet-transport rollers 610B significantly differ, which may cause failure to stably feed sheets 9 to the second-transfer position TP2, serving as the transport destination.

For example, when a wide sheet 9A is transported, because the middle portion thereof in the width direction E is subjected to a lower pressure-contact load than the ends, the transportation force (transport speed) with respect to the middle portion thereof is lower than that with respect to the ends, which potentially causes creases or a transfer defect at the second-transfer position TP2, serving as the transport destination. When a narrow sheet 9B is transported, although the sheet is not subjected to an excessive pressure-contact load from the inner separate rollers 65B and 67B, and 65C and 67C, low pressure-contact loads may result in insufficient transportation force.

In Comparison Example 3, instead of the pre-transfer sheet-transport rollers 61, for example, pre-transfer sheet-transport rollers in which all four separate rollers 65A, 65B, 65C, and 65D of the first roller 62 have the same hardness, J2, and all four separate rollers 67A, 67B, 67C, and 67D of the second roller 63 have the same outside diameter, K2, are used.

Figure 9A:
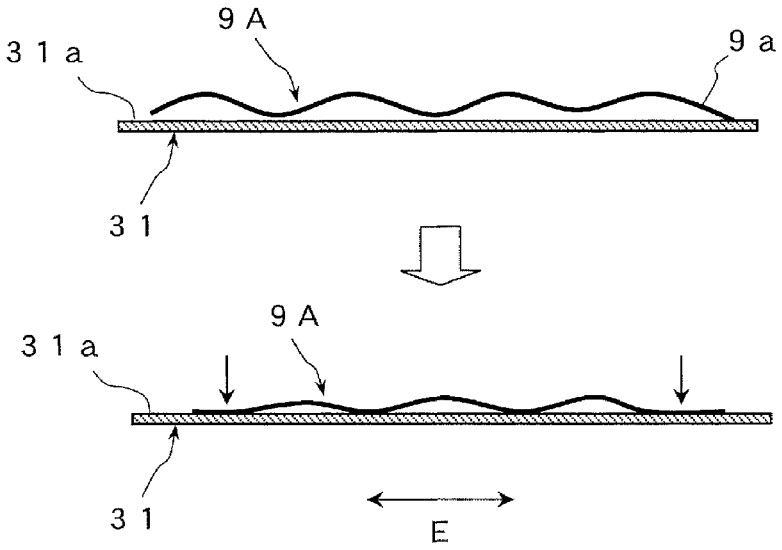
FIG. 9A shows a state of a sheet when the sheet with wave-like deformation is fed out by the pre-transfer sheet-transport rollers, and a contact state between the intermediate transfer belt and the sheet in that state.

As shown in FIG. 9A, when a wide sheet 9A is transported with the aforementioned pre-transfer sheet-transport rollers, the wide sheet 9A may be fed such that the leading-end portion 9*a* thereof in the transport direction D is deformed in a wave-like shape in the width direction E. In this case, if the leading-end portion 9*a* of the wide sheet 9A or the ends at the trailing end thereof first come into contact with the substantially flat outer surface 31*a* of the intermediate transfer belt 31 of the intermediate transfer part 3, the middle portion thereof, which is deformed in a wave-like shape, may come into contact with the outer surface 31*a* of the intermediate transfer belt 31. This causes creases or a transfer defect at the second-transfer position TP2, serving as the transport destination.

In Comparison Example 4, pre-transfer sheet-transport rollers, serving as the pre-transfer sheet-transport rollers 61, in which the second roller 63 is disposed on the side to be in contact with the surface (transfer target surface) 9*c* of the sheet 9 to which an unfixed toner image is transferred are used.

Figure 9B:
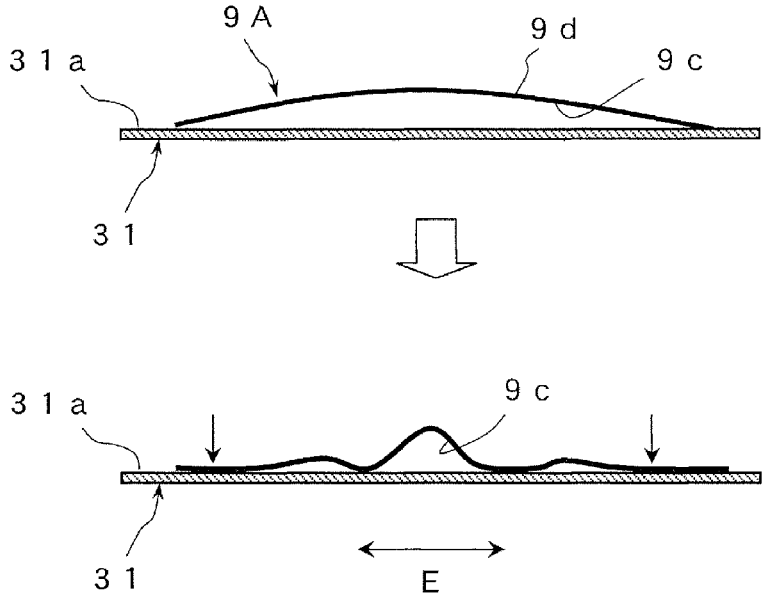
FIG. 9B shows a state of a sheet when the sheet that is curved so as to project toward a surface opposite to a transfer target surface is fed out by the pre-transfer sheet-transport rollers, and a contact state between the intermediate transfer belt and the sheet in that state.

As shown in FIG. 9B, when a wide sheet 9A is transported with the aforementioned pre-transfer sheet-transport rollers, the wide sheet 9A is fed such that the middle portion thereof in the width direction E is curved so as to project toward the surface (9*d*) side, which is opposite to the transfer target surface 9*c*. As a result, the leading-end portion 9*a* of the wide sheet 9A or the ends at the trailing end thereof first come into contact with the substantially flat outer circumferential surface 31*a* of the intermediate transfer belt 31 of the intermediate transfer part 3, and then, the middle portion thereof gradually approaches and comes into contact with the outer surface 31*a* of the intermediate transfer belt 31. Hence, in particular, a portion of the middle portion thereof remain away from the outer surface 31*a* of the intermediate transfer belt 31 (that is, the portion remains as strain). This causes creases or a transfer defect at the second-transfer position TP2, serving as the transport destination.

Other Exemplary Embodiments

In the first exemplary embodiment, the pre-transfer sheet-transport rollers 61 include the first roller 62 having the four separate rollers 65A to 65D, and the second roller 63 having the four separate rollers 67A to 67D. However, the sheet-transport rollers 61 may include a first roller 62 having three or five or more separate rollers 65 and a second roller 63 having three or five or more separate rollers 67.

Furthermore, although the first roller 62 and the second roller 63 each have two end separate rollers disposed at the ends of the shaft 64 or 66, depending on the necessity, the first roller 62 and the second roller 63 may each have four or more separate rollers disposed at the ends of the shaft 64 of 66.

Although the three or more separate rollers of the first roller 62 and the second roller 63 have the same width, i.e., the length in the axial direction, depending on the necessity, the width of a part of separate roller may differ from those of the others.

In the first exemplary embodiment, a configuration example in which the sheet transport device 6 is applied to the image forming apparatus 1 that uses the intermediate transfer part 3 (intermediate-transfer method) has been shown. However, the sheet transport device 6 may also be applied to an image forming apparatus that does not use the intermediate transfer part 3 (intermediate-transfer method). In that case, a photoconductor, such as the photoconductive drum 21, that carries an unfixed toner image serves as an image carrier. In that case, the sheet transport device 6 transports a sheet 9 to a transfer position between the photoconductor, such as the photoconductive drum 21, and a transfer device.

Other examples of the image forming apparatus to which the sheet transport device 6 is applied include, besides image forming apparatuses that employ an image recording method in which toner images are formed of developer, image forming apparatuses that use other image recording methods in which, for example, images are formed of other materials, such as ink. In that case, the sheet transport device 6 transports a sheet 9 to a print position at which ink droplets are discharged from an image-forming part (print head) to print an image.

The foregoing description of the exemplary embodiments of the present invention has been provided for the purposes of illustration and description. It is not intended to be exhaustive or to limit the invention to the precise forms disclosed. Obviously, many modifications and variations will be apparent to practitioners skilled in the art. The embodiments were chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. A sheet transport device comprising pre-transfer sheet-transport rollers that transport a sheet to a transfer position at which an unfixed image is transferred, the pre-transfer sheet-transport rollers including a first roller in which three or more separate rollers attached to a first shaft rotate, and a second roller in which three or more separate rollers attached to a second shaft are in contact with the separate rollers of the first roller and rotate, wherein the hardness of an inner separate roller of the first roller is lower than the hardness of outer separate rollers of the first roller that are located outside and adjacent to the inner separate roller, the outside diameter of an inner separate roller of the second roller is greater than the outside diameter of outer separate rollers of the second roller that are located outside and adjacent to the inner separate roller, when the sheet being transported is a narrow sheet that is transported by being nipped between only the inner separate roller of the first roller and the inner separate roller of the second roller, a pressure-contact load between the inner separate roller of the first roller and the inner separate roller of the second roller is higher than a pressure-contact load between each outer separate roller of the first roller and each corresponding outer separate roller of the second roller, and when the sheet being transported is a wide sheet that is transported by being nipped between the inner separate roller and the outer separate rollers of the first roller and the inner separate roller and the outer separate rollers of the second roller, the pressure-contact load between the inner separate roller of the first roller and the inner separate roller of the second roller is substantially equal to the pressure-contact load between each outer separate roller of the first roller and each corresponding outer separate roller of the second roller.

2. An image forming apparatus comprising;

an image carrier that carries an unfixed image; a transfer device that transfers the unfixed image on the image carrier to a sheet; and the sheet transport device according to claim 1 that transports the sheet to a transfer position between the image carrier and the transfer device.

3. The sheet transport device according to claim 1, wherein, in the pre-transfer sheet-transport rollers, the first roller is disposed on the side to be in contact with a surface of the sheet to which the unfixed image is to be transferred.

4. The sheet transport device according to claim 1, wherein the pre-transfer sheet-transport rollers are configured such that the first roller serves as a driving roller that drivingly rotates and such that the second roller serves as a driven roller that is rotated in a driven manner.

5. The sheet transport device according to claim 3, wherein the pre-transfer sheet-transport rollers are configured such that the first roller serves as a driving roller that drivingly rotates and such that the second roller serves as a driven roller that is rotated in a driven manner.

* * * * *